United States Patent [19]

Nakanishi et al.

[11] Patent Number: 4,796,018

[45] Date of Patent: Jan. 3, 1989

[54] EXIT GUIDING SYSTEM

[75] Inventors: Tsutomu Nakanishi, Machida, Japan; Akira Kitajima, Huntington Beach, Calif.; Yoshiaki Fuwa, Yokohama; Yasaburo Adachi, Nara, both of Japan

[73] Assignee: Hockiki Corp., Tokyo, Japan

[21] Appl. No.: 53,371

[22] Filed: May 22, 1987

[30] Foreign Application Priority Data

May 26, 1986 [JP] Japan ..... 61-120888

[51] Int. Cl.[4] ..... G08B 17/10; G08B 7/06

[52] U.S. Cl. ..... 340/691; 315/76; 340/628

[58] Field of Search ..... 340/691, 945, 628; 169/23, 61, 56; 315/76, 149, 155, 158

[56] References Cited

U.S. PATENT DOCUMENTS 4,074,225 2/1978 Vandeweghe ..... 340/691

4,283,657 8/1981 Gordon et al. ..... 340/691

4,319,234 3/1982 Rice ..... 340/628

4,531,114 7/1985 Topol et al. ..... 340/691

*Primary Examiner*—Glen R. Swann, III

*Attorney, Agent, or Firm*—Lackenbach Siegel Marzullo & Aronson

[57] ABSTRACT

An exit guiding system comprising detectors of changes in ambient condition due to a fire, a guiding device positioned near each fire exit or exit access, instruction means controlling operation or non-operation of each guiding device based upon signal levels from said detectors, operation of each guiding device being initiated when any detector outputs a signal indicating a dangerous condition, operation of individual guiding devices being suspended when ambient conditions local to said guiding device are dangerous, except the guiding device continuing operation when local conditions inside a door are dangerous but local conditions outside the same door are acceptable.

7 Claims, 4 Drawing Sheets

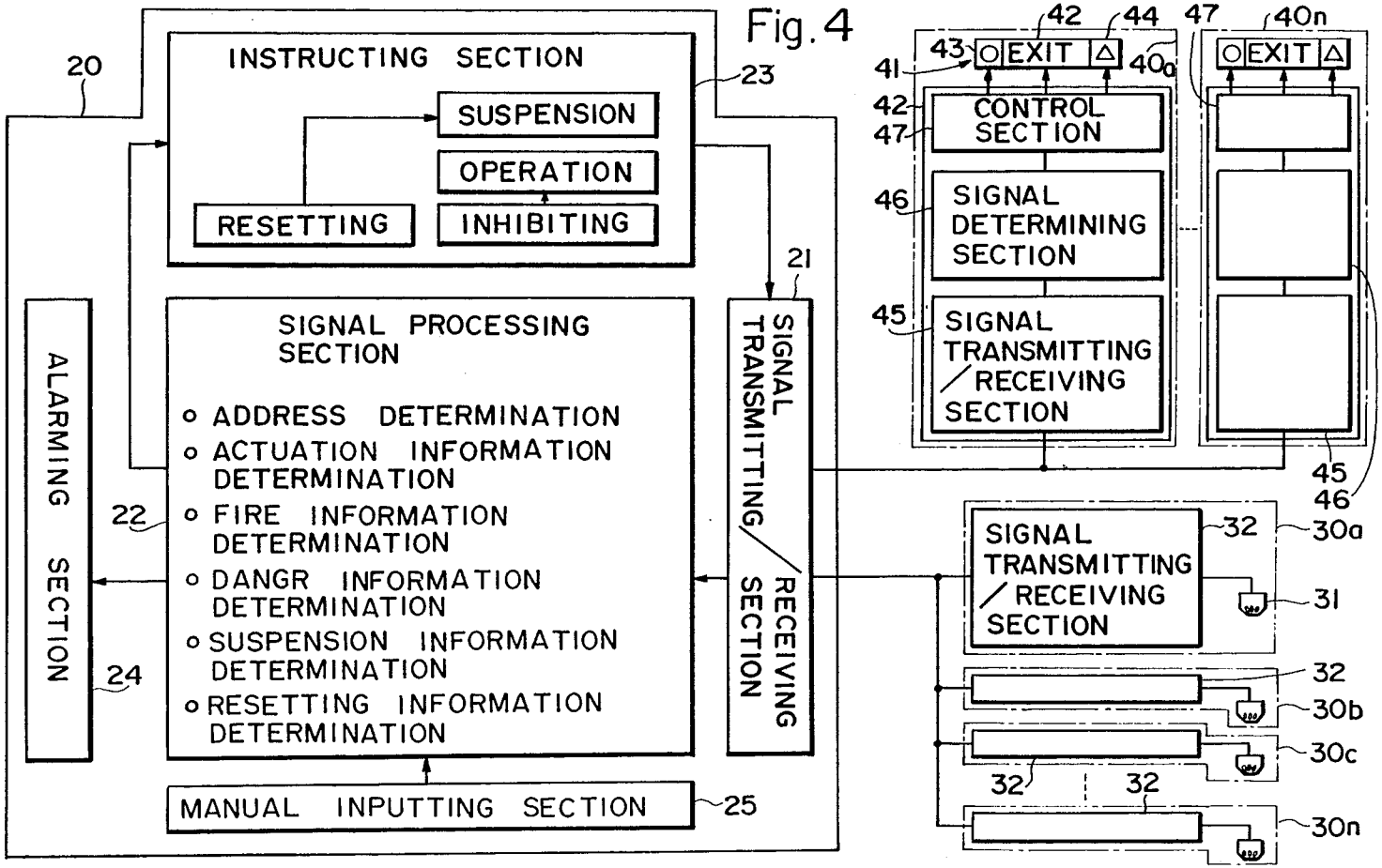
Fig. 4
CONTROL SECTION
SIGNAL DETERMINING SECTION
SIGNAL TRANSMITTING / RECEIVING SECTION
EXIT
SIGNAL TRANSMITTING / RECEIVING SECTION
SIGNAL TRANSMITTING / RECEIVING SECTION
INSTRUCTING SECTION
SUSPENSION
OPERATION
INHIBITING
RESETTING
SIGNAL PROCESSING SECTION
o ADDRESS DETERMINATION
o ACTUATION INFORMATION DETERMINATION
o FIRE INFORMATION DETERMINATION
o DANGR INFORMATION DETERMINATION
o SUSPENSION INFORMATION DETERMINATION
o RESETTING INFORMATION DETERMINATION
MANUAL INPUTTING SECTION
ALARMING SECTION

EXIT GUIDING SYSTEM

BACKGROUND OF THE INVENTION

This invention relates to an exit guiding system which is provided in an access or passageway to a fire exit for indicating a guiding direction toward the exit.

In conventional exit guiding devices provided on walls around fire exits for indicating the positions of the fire exits, messages indicative of the exit or symbol marks are indicated by illuminating built-in light sources. It has been proved that these indications by light become hard to see at the time of fire, due to smoke caused by the fire. To solve this problem, it has been proposed that a flashing light device such as a xenon tube be provided in the exit guiding device and the xenon tube be driven to emit light at the time of fire for making the indication visible even in the smoke. Or, there is another proposal to indicate the exit to those who have poor sight. In this proposal, a voice outputting device is provided in the exit guiding device, so that it may give a vocal message for escape guidance at the time of fire, at a volume of, for example, 90dB or more.

However, these escape guiding devices have the disadvantage that not only those who have poor sight but also normal persons may possibly be guided by the flashing light or vocal messages, to exits which have already become dangerous. This occurs if guidance by the flashing light or vocal message is continued even after the exits or the accesses to the exits are already dangerous due to permeation of smoke.

SUMMARY OF THE INVENTION

The present invention has been made to obviate the prolems involved in the prior art, and it is an object of the present invention to provide an exit guiding system capable of ensuring safe and reliable escape guidance. The system suspends operation of a guiding device provided in an exit or access when a fire exit or the exit access becomes dangerous due to a fire. This mode ensures proper guidance to safe fire exits, while surely preventing undesired guidance to the fire exit which has already become dangerous.

In accordance with the present invention, there is provided an exit guiding system which comprises detectors for detecting a change in the ambient conditions due to a fire, a guiding device provided near each fire exit or in each exit access for guiding escape at the time of a fire, and instructing means for instructing actuation or suspension of operation of each guiding device based on the detection signals of the detectors, said instructing means being adapted to output an operation signal when the detection signal of a detector reaches a predetermined danger level, and each said guiding device being adapted to suspend operation in response to an operation-suspending signal from said instruction means.

BRIEF DESCRIPTION OF THE DRAWINGS

FIG. 4 is a block diagram showing another embodiment of the present invention;

PREFERRED EMBODIMENTS OF THE INVENTION

Figure 1:
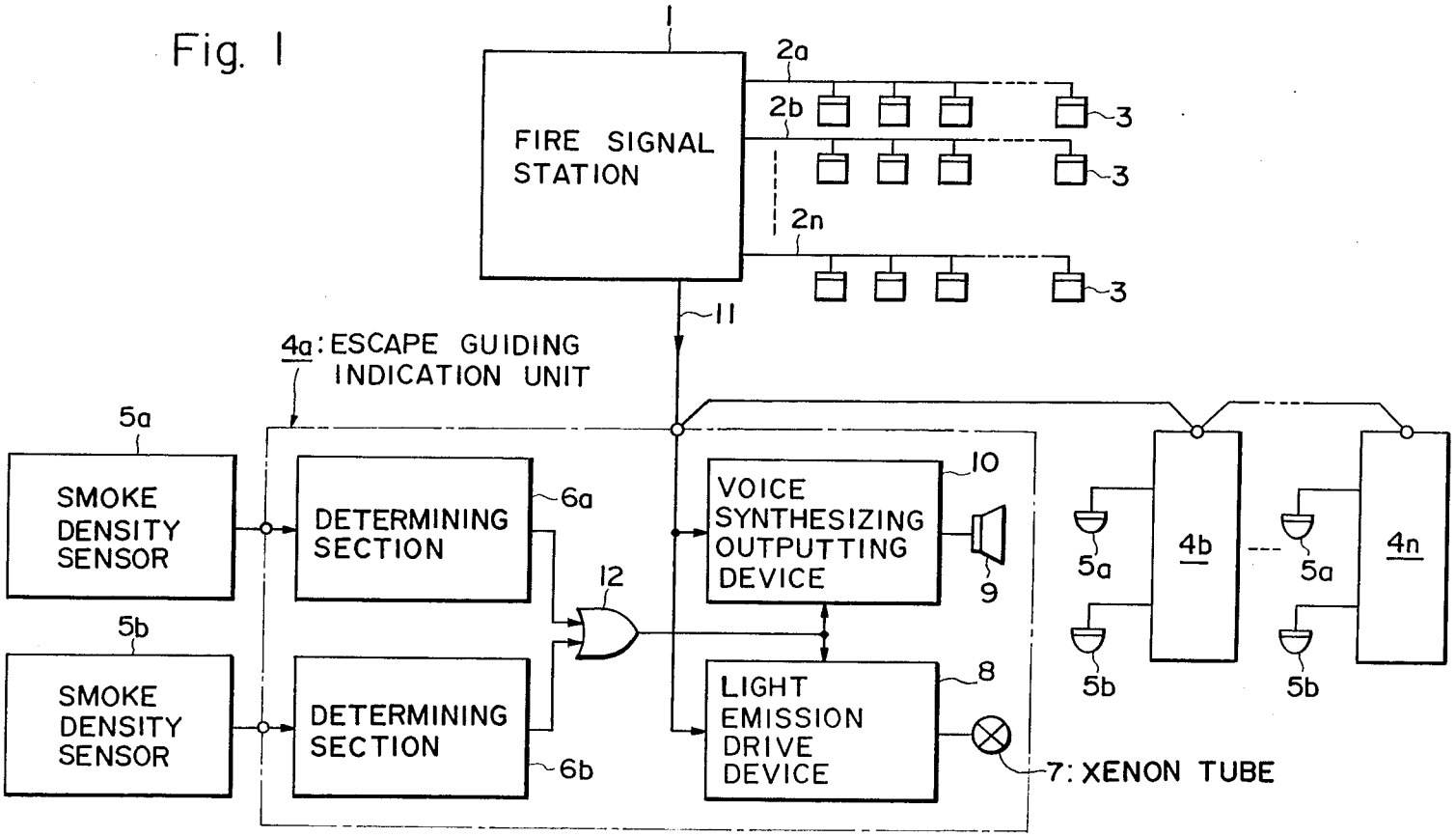
FIG. 1 is a block diagram of one embodiment of the present invention.

Referring now to the drawings, preferred embodiments of the present invention will be described.

In FIG. 1, 1 is a fire signal station and 2*a*, 2*b* . . . 2*n* are signal lines derived from the signal station 1 to various lookout or watching regions. The signal lines 2*a* to 2*n* are connected to fire detectors 3 in the respective watching regions. The fire detectors 3 may be so-called on-off type fire detectors which output a fire detection signal when a change in environmental conditions caused by a fire, for example, a temperature and/or smoke density reaches a preset threshold level, or may be analog fire detectors which output analog fire detection signal corresponding to a temperature or smoke density.

4*a* to 4*n* are exit guiding indication units which are installed in the vicinity of fire exits or on walls of passageways of accesses to the exit.

Figure 2:
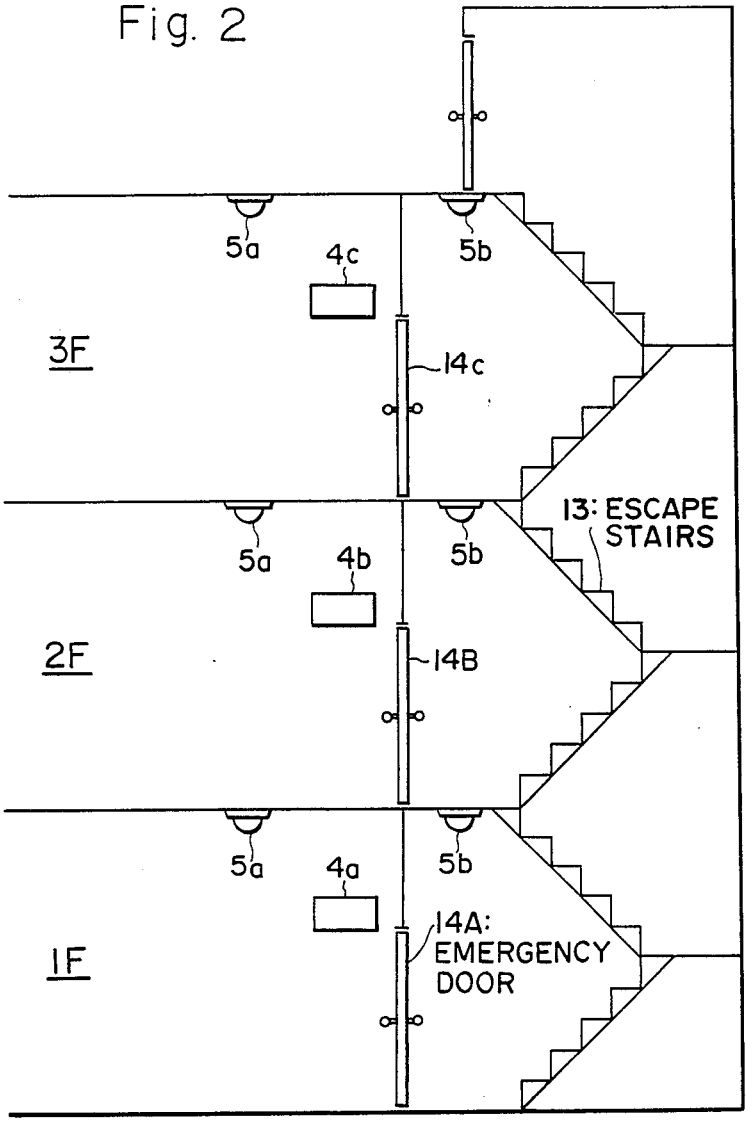
FIG. 2 is a schematic sectional view of an exit guiding system of the present invention which is provided in the vicinity of fire exits of a three-floor building.

As illustrated in FIG. 2, emergency doors 14A to 14C are provided at respective fire exits leading to fire escape stairs 13 in a building having first to third floors 1F to 3F. The exit guiding indication units 4*a* to 4*c* each having a configuration as illustrated in FIG. 1 are provided inside the emergency doors 14A to 14C in the vicinity of the fire exits, respectively. Smoke density sensors 5*a* are provided on ceilings of the respective floors 1F to 3F, inside the respective emergency doors 14A to 14C. Similarly, smoke density sensors 5*b* are provided on ceilings of the fire escape stairs 13, outside of the respective emergency doors 14A to 14C.

Each of the exit guiding indication units 4*a* to 4*n* has the same configuration, and an exit guiding indication unit will now be described.

Detection signals from the smoke density sensors 5*a* and 5*b*, provided inside and outside of the fire exit where the exit guiding indication unit 4*a* is located, are inputted to determining sections 6*a* and 6*b* provided in the exit guiding indication unit 4*a*, respectively. Danger levels of smoke density at the fire exit are set as threshold values in the determining sections 6*a* and 6*b*. The threshold values are, for example, smoke density of 20%/m. If the smoke density or densities indicated by the detection signal or signals from the smoke density sensor 5*a* and/or 5*b* exceed the preset threshold value, the determining section or sections 6*a* and/or 6*b* generate an H-level output.

The exit guiding indication unit 4*a* includes a light emission drive device for driving light emission of a xenon tube 7 and a voice synthesizing/outputting device 10 for outputting a voice message for fire escape guidance. The light emission drive device 8 and the voice synthesizing/outputting device 10 are actuated in response to a fire detection signal from the fire signal station 1. The light emission drive device 8 intermittently drives the xenon tube 7 to emit light intermittently at predetermined time intervals. The xenon tube 7 generates intense flashing light to indicate the position of the fire exit. The voice synthesizing/outputting device 10 stores vocal data of previously given escape guiding messages. The voice synthesizing/outputting device 10 reads out the vocal data, when it receives the fire detection signal 11 from the fire signal station 1, to synthesize a required voice message. The message for escape guidance is outputted near the fire exit, at sufficiently high volume, for example, at volume of 90 dB or more, through a loudspeaker 9 after amplification by a voice amplifier.

When outputs from the determining sections *6a, 6b* are supplied, as stop signals, to the light emission drive device 8 and the voice synthesizing/outputting device 10 through an OR gate 12, the devices stop their operations. Thus, the light emission of the xenon tube 7 and the outputting of the voice message through the loudspeaker 9 are stopped.

Figure 3:
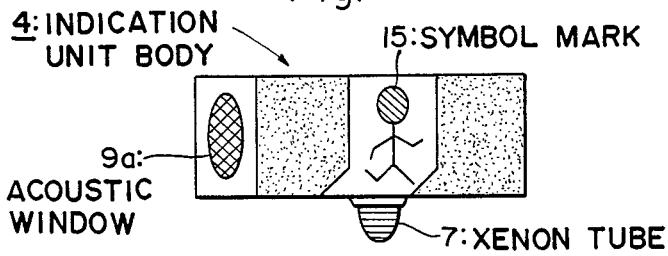
FIG. 3 is an explanatory front view of the exit guiding indication unit of the invention, which includes a flashing device and a voice outputting device.

Each of the exit guiding indication units 4*a* to 4*c* provided on walls of the inside of the emergency doors of the respective floors is configured to have an appearance as shown, for example, in FIG. 3.

More particularly, a symbol mark 15 indicative of a direction to the fire exit (or a written message such as "Fire Exit") is provided on a front face of the indication unit body 4. A light source such as fluorescent lamp built in the unit body 4 is always lit to irradiate the symbol mark 15. The light source is supplied with power from an external power source through the fire signal station 1. To prevent extinction of the symbol mark 15 due to possible power failure due to a fire, an emergency power source is provided in the fire signal station 1 or an emergency power source is provided in each of the indication units 4*a* to 4*c*. Thus, the illumination indication of the symbol mark 15 is assured both at a normal time and in an emergency situation.

The xenon tube 7 is provided at a bottom of the indication unit body 4 and the loudspeaker 9 is encased within an acoustic window 9*a* on the left of the indication unit body 4. The loudspeaker 9 is utilized also for emergency anouncement as well as for escape guidance messages.

A control operation of the present embodiment for escape guidance will now be described, referring to FIGS. 1 and 2.

When the fire signal station 1 receives a fire signal from the fire detector 3, a fire alarm such as local bell ringing is given. At the same, fire detection signals 11 are supplied to the respective units 4*a* to 4*c* to actuate the light emission drive device 8 and the voice synthesizing/ outputting device 10 provided in the respective units 4*a* to 4*c*. This, in turn, activates the xenon tubes 7 of the respective exit guiding indication units 4*a* to 4*c* at the inside of the emergency doors 4A to 4C. Simultaneously, the voice message for escape guiding is given at volume of 90 dB or more.

With this arrangement, the escaping persons in the building can surely and properly know the direction to the fire exits as a result of the intense light emission of the xenon tube 7 even if smoke due to the fire permeates the building. Moreover, the escaping persons can confirm the direction to the fire exits through the escape guidance message in combination with the light emission of the xenon tube 7 to take quick escaping action. Furthermore, persons who have poor eyesight can also know the direction to the fire exits through the anouncement of the escape guidance message to take quick action for escape.

On the other hand, the smoke density sensors *5a, 5b* detect smoke densities around the fire exits and the determining sections *6a,* 6 provided in the respective escape guide indication units 4*a* to 4*c* determine whether the detected smoke densities reach a predetermined danger level or not.

If the fire spreads around the fire exit 14C on the third floor and the smoke density detected by the smoke density sensor 5*a* or 5*b* or both of them reaches the predetermined danger level, the corresponding determining section 6*a* or 6*b* or both of them in the unit 4*c* generate a determination output of H level. This output is supplied to the light emission drive device 8 and the voice synthesizing/outputting device 10 as a stop signal. As a result of this, the driving of the xenon tube 7 for light emission and the outputting of the voice message through the loudspeaker 9 are suspended to stop escape guidance to the fire exit 14C. However, the light emission and voice message announcements of the units 4*a* and 4*b* at the fire exits 14A and 14B respectively, are continued. With this arrangement, it is possible to guide escaping people to the safe fire exits 14A and 14B, while preventing inappropriate guiding of the people to the fire exit 14C, which has now become dangerous.

In the embodiment as illustrated in FIG. 1, only escape guidance by light emission of the xenon tube 7 and the announcement of the voice message through the loudspeaker 9 is suspended. The illumination indication by lighting the built-in light source for the symbol mark 15 is continued.

As described above, light emission of the xenon tube 7 and announcement of voice messages are suspended when the smoke density detected by either of the smoke density sensors 5*a* and 5*b* reaches the danger level in the present embodiment. However, escape through the fire exit is possible, when the smoke density outside the exit does not reach the danger level, even if the smoke density inside the fire exit exceeds the danger level. Therefore, it is satisfactory when the escape guidance is suspended only when the detected smoke density by the smoke density sensor 5*b,* provided outside the fire exit, reaches the predetermined danger level. Alternatively, the detection value from the smoke sensor 5*a* inside the fire exit may be compared with the detection value of the smoke sensor 5*b* outside the fire exit so as to suspend escape guidance only when the smoke density detected by the smoke density sensor 5*b* outside the exit is larger.

Although both the light emission driving of the xenon tube 7 and the anouncement of the vocal message are suspended when the smoke density reaches the danger level in the embodiment as described above, only one of them may be suspended alternatively, while continuing the operation of the other. This would be an inhibited condition.

In addition, although the voice synthesizing/outputting device 10 is provided in the escape guiding indication unit in the foregoing embodiment, the voice synthesizing/outputting device may alternatively be provided on the side of the fire signal station 1 to transmit a voice signal to each of the escape guiding indication units 4*a* to 4*n*.

Figure 5:
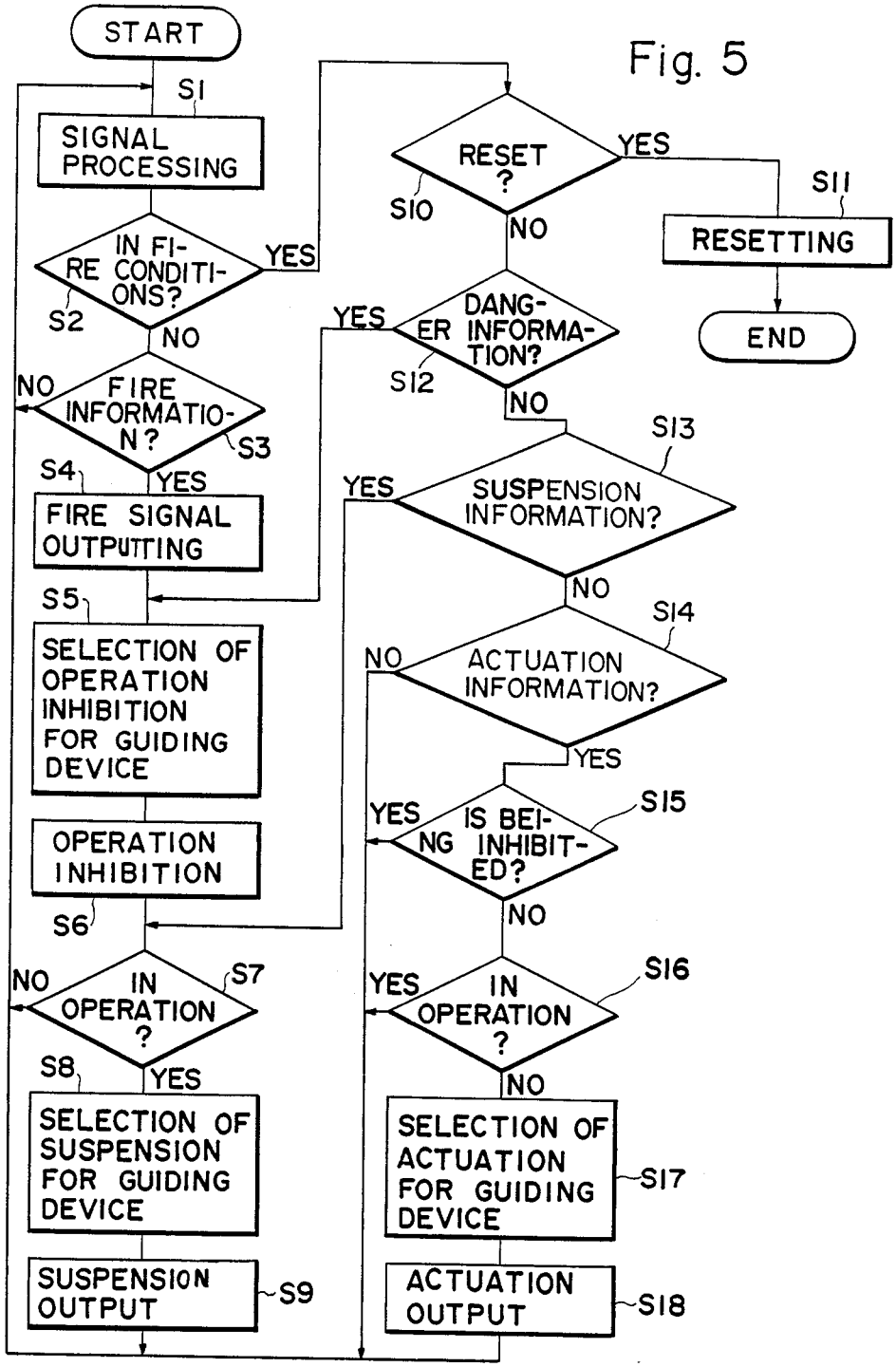
FIG. 5 is a flowchart of a control operation of the embodiment as illustrated in FIG. 4.

Another embodiment of the present invention will now be described, referring to FIGS. 4 and 5. In this embodiment, the smoke density sensors are not provided in the respective escape guiding indication units and a fire signal station is adapted to effect danger determination for controlling the actuation and suspension of the escape guiding devices.

As illustrated in FIG. 4, 20 is a fire signal station and a plurality of fire detectors 30*a* to 30*n* and a plurality of guiding devices 40*a* to 40*n* provided in exit passageways or accesses to respective fire exits are connected to the fire signal station 20 through signal lines. The fire detectors 30*a* to 30*n* are associated with the guiding devices 40*a* to 40*n*, for example, by matrix, so as to have definite correspondences or predetermined relationships therebetween, respectively. More particularly, it has been previously determined which corresponding guiding device 40*a* to 40*n* is to be actuated when one of the fire detectors 30*a* to 30*n* detects a fire.

The fire signal station 20 comprises a signal transmitting/receiving section 21, a signal processing section 22, an instructing section 23, an alarming section 24 and a manual inputting section 25 for level setting, restoring input, suspending input, etc. The signal transmitting-/receiving section 21 is an input/output port for the delivery of signals between the fire detectors 30*a* to 30*n* and the guiding devices 40*a* to 40*n* and the fire signal station 20. The signal processing section 22 carries out an evaluation on the basis of the signal from the fire detectors 30*a* to 30*n* or the manual inputting section 25. The data evaluation to be carried out by the signal processing section 22 includes evaluation of address information of the fire detectors 30*a* to 30*n* and the guiding devices 40*a* to 40*n*, evaluation of operation and fire and danger status based on detection signals from the fire detectors 30*a* to 30*n*, evaluation of actuation/-suspension inputs from the manual inputting section 25, and determination of resetting information.

The instructing section 23 controls the actuation/suspension of the guiding devices on the basis of output signals from the signal processing section 22. An instruction signal from the instructing section 23 is supplied to the relevant guiding device 40*a* to 40*n* through the signal transmitting/receiving section 21. The signal processing section 22 and the instructing section 23 may be provided in the form of a microcomputer.

The alarming section 24 sounds a bell to indicate occurrence of a fire in response to a fire indication signal from the signal processing section 22.

The manual inputting section 25 allows manual setting and inputting of a level on which the evaluation of the signals from the fire detectors 30*a* to 30*n* is based, and inputting of actuating information, suspending information and resetting information for effecting the actuation, suspension and resetting of the guiding device 40*a* to 40*n* when appropriate. The level setting is effected by setting, in the form of smoke density etc., threshold values for actuation information, for comparing with fire information and danger information. For example, a threshold value for actuation information is set at 5%/m of smoke density, a threshold value for fire information is set at 10%/m of smoke density and the threshold value of danger information is set at 20%/m of smoke density. With these settings, if the smoke densities detected by the fire detectors 30*a* to 30*n* are, for example, 5 to 10%/m, then the signal processing section 22 carries out evaluation of the actuation information and outputs an actuating information signal to the instructing section 23, so that the instructing section 23 may supply an actuating signal to the guiding devices 40*a* to 40*n*. The resetting information is to initialize the guiding devices 40*a* to 40*n*. The manual inputting section 25 is, for example, a keyboard.

The fire detectors 30*a* to 30*n* are each comprised of a fire sensor 31 and a signal transmitting/receiving section 32. The fire sensor 31 may be an on-off type or an analog type detector as described above. The on-off type detector employable in the present invention may be such that it can output different signals corresponding to the signal processing levels. The detection signal of the fire sensor 31 is supplied to the signal transmitting/outputting section 21 of the fire signal station 20 through the signal transmitting/outputting section 32.

The guiding devices 40*a* to 40*b* are each comprised of an indication unit 41 and a signal device 42. The indication unit 41 is similar to that shown in FIGS. 1 and 3, and it comprises a symbol mark 42 irradiated by, for example, a fluorescent lamp, a flashing light 43 which intermittently emits light by driving of an xenon tube, etc. to alert people in escape passageways, and an acoustic device 44 for generating sounds such as escape guidance messages.

The signal device 42 comprises the signal transmitting/receiving section 45 for delivering signals in relation with the fire signal station 20, a signal determining section 46 for effecting evaluation of the signals and a control section 47 for actuating/suspending the flashing light 43 and the acoustic device 44.

For example, a signal transmitted from the instructing section 23 of the fire signal station 20 is received by the signal transmitting/receiving section 45 and supplied to the signal determining section 46. The signal determining section 46 interprets the signal contents and outputs a signal to the control section 47 corresponding to the determined contents. The control section 47 drives the flashing light 43 and the acoustic device 44 of the indication unit 41, according to the contents of the signal from the signal determining section 46, to effect guidance toward the escape passageway or access by light and sound.

The control operation of the embodiment as described above and illustrated in FIG. 4 will now be described, referring to a flow chart of FIG. 5. The processing flow comprises two systems. Generally speaking, when no signal indicative of fire information is received from any of the fire detectors 30, processing is carried out in the procedures from step S2 to S3, S4, S5 . . . However, if a signal indicative of fire is input, the signal processing section 22 is entirely put into a "fire condition" mode and the processing is carried out in the procedures from step 2 to step S10, S11, S12 . . .

When a detection signal is transmitted to the fire signal station 20 from any one of the fire detectors 30*a* to 30*n*, the fire signal station 20 carries out signal evaluation, at step S1, as to determining the address of the fire detector and the content of the detection information. Then, it is determined, at step S2, whether or not the fire condition mode has already been set. If the fire condition mode has not yet been set, the procedures proceed to step S3. At step S3, it is determined whether the transmitted detection signal indicates a fire exists or not, or the signal level exceeds the threshold value (for example, smoke density of 10%/m) of a fire level or not. If the signal does not indicate a fire, the procedures return to step S1 to repeat the above-mentioned operations on a detection signal from another detector next to the detector as described above. On the other hand, if the signal level is that of a fire, then the procedures proceed to step S4 to drive the alarming section 24 for indicating occurrence of a fire.

Then, at step S5, the signal processing section 22 checks the guiding devices 40*a* to 40*n* for areas where the escape guidance should be stopped. This is accomplished by determination of the address of the fire detector 30*a* to 30*n* which transmitted a fire detection signal. This determination is made by a matrix. Then, if necessary, the signal processing section 22 outputs an instruction to the instructing section 23 to stop the operation. Subsequently, the guiding device determined at step S5 is put into an operation-stopped state. Thereafter, at step S7, it is determined whether the guiding device 40*a* to 40*n* which has been put into the operation-stopped state is still operating (flashing light 43 and the acoustic device 44 are in operation) or not. If it is not in operation, the procedures return to step S1 and if it is in operation, the guiding device 40*a* to 40*n* to be turned off is selected at step S8. At step S9, the operation of the selected guiding device 40*a* to 40*n* is suspended and the procedures return to step S1.

If a detection signal is output from another fire detector 30*a* to 30*n* after the fire condition mode has already been set, the procedures proceed from step S2 to step S10 to determine whether resetting information has been input from the manual inputting section 25 or not. If resetting information has been input, the guiding devices 40*a* to 40*n* are reset to the respective initial states at steps 11 to terminate the processing. Thus, a prior actuation suspension instruction by a signal output to the respective guiding device is released.

If there is no resetting information at step S11, it is determined at step S12 whether the detection signal from the fire detector 30*a* to 30*n* is a danger signal or not, or exceeds the threshold value (for example, a smoke density of 20%/m) of the danger level or not. If the signal is a danger signal, the procedures proceed to step S5 and operations as described above are carried out at steps after step S6. If the signal is not a danger signal, it is determined at step 13 whether suspension information has been input at the manual inputting section 25. If there has been an input, the procedures proceed to step S7 to carry out steps S8 and S9. If there has been no suspension information input, it is determined at step S14 whether the detection signal from the fire detector 30*a* to 30*n* is an actuating signal or not, or whether it exceeds the threshold value (a smoke density of 5%/m) of the actuating level or not. If the signal is lower than the threshold value, the procedures return to step S1, whilst if the signal exceeds the threshold value, the procedures proceed to step S15. In this connection, it is to be noted that actuating information may be input manually by the manual inputting section 25. In this case, the procedures proceed to step S15 as a result of the input, irrespective of the signals from the fire detectors 30*a* to 30*n*.

At step S15, it is determined whether the guiding device 40*a* to 40*n*, corresponding to the fire detectors 30*a* to 30*n* which has transmitted a detection signal, is in the operation-inhibited condition or not. If it is in the operation-inhibited condition, the procedures return to step S1. If it not in the operation-inhibited condition, it is further determined at step S16 whether the guiding device has already been actuated or not. If the device is in operation, the procedures return to step S1, and if the device is not in operation, the guiding device to be actuated is selected at step S17. At step S18, the selected guiding device 40*a* to 40*n* is actuated.

The control operations as described above are carried out for all of the fire detectors 30*a* to 30*n*.

As described above, according to the present embodiment, the evaluation of fire information, danger information and actuation information is made and the guiding devices 40*a* to 40*n* which are to be actuated, turned-off or subjected to an operation inhibition, are selected on the basis of the detection signals from the fire detectors 30*a* to 30*n*. Thus, only guiding devices 40*a* to 40*n* in safe escape passageways are operated, while keeping the guiding devices 40*a* to 40*n* in dangerous escape passageways turned off. Therefore, improper guiding to dangerous exit passageways can be surely avoided, ensuring safe and proper escape guidance.

Further in situations where the xenon tube 7, flashing light 43, speaker 9 and the acoustic device 44 are not provided in the escape guiding indication unit 4, 41, the object to be controlled into an operation or suspended operation state by the present invention may be an indication unit where only a symbol mark for showing an escaping route is attached.

We claim:

1. An exit guiding system comprising:

a first detector for positioning inside a building for detecting a change in the indoor ambient conditions due to occurrence of at least one of smoke and fire;

a second detector for positioning outside of said building for detecting a change in the outdoor ambient conditions due to occurrence of at least one of smoke and fire, said first and second detectors outputting signals at levels related to the intensity level of said smoke and fire;

a guiding device for positioning near a fire exit or in an access to an exit for providing escape guidance at the time of a fire;

instructing means for causing performance or suspension of at least a portion of operations of said guiding device, said suspension being based on said signal levels of said respective detectors;

said instructing means including evaluation means for determining whether or not the respective signal levels of said detectors reach a predetermined danger level;

said evaluation means comparing the signal level of said inside first detector with the signal level of said outside second detector when the signal level of either detector reaches said danger level, said evaluation means outputting an operation siganl to said guiding device when the signal level of said inside first detector is greater than that of the outside second detector, on the other hand, said evaluation means outputting a suspension signal to said guiding device when the signal level of the outside detector is higher than that of said inside detector; and said guiding device being adapted to operate or suspend said at least a portion of the operations in response to the respective operation and suspension signals from said instructing means.

2. An exit guiding system as claimed in claim 1, wherein said instructing means are located in said guiding device and said detectors are connected with said guiding device.

3. An exit guiding system as claimed in claim 2, wherein said instructing means are included in a fire signal station and said detectors are connected with said fire signal station.

4. An exit guiding system as claimed in claim 1, wherein said guiding device includes at least one of an indicating device for guiding by light and an acoustic device for guiding by sound.

5. An exit guiding system as claimed in claim 4, wherein operation of at least one of said indication device and said acoustic device is suspended by said suspension signal output.

6. An exit guiding system as claimed in claim 1, in which said indication device includes at least one of a mark indicating unit and a xenon tube, operation of at least one of said unit and tube is suspended by said suspension signal output.

7. An exit guiding system as claimed in claim 1, wherein said guiding device includes a voice outputting device for giving a vocal guidance message.

* * * * *